US008848951B2

(12) United States Patent
Van Daele et al.

(10) Patent No.: US 8,848,951 B2
(45) Date of Patent: Sep. 30, 2014

(54) SPEAKER ARRAY AND DRIVER ARRANGEMENT THEREFOR

(75) Inventors: Bert Albert Elfrida Van Daele, Leuven (BE); Kheng Wee Wee, Singapore (SG)

(73) Assignee: Koninklijke Philips N.V., Eindhoven (NL)

( * ) Notice: Subject to any disclaimer, the term of this patent is extended or adjusted under 35 U.S.C. 154(b) by 272 days.

(21) Appl. No.: 12/919,790

(22) PCT Filed: Mar. 9, 2009

(86) PCT No.: PCT/IB2009/050962

§ 371 (c)(1), (2), (4) Date: Aug. 27, 2010

(87) PCT Pub. No.: WO2009/113002

PCT Pub. Date: Sep. 17, 2009

(65) Prior Publication Data

US 2011/0002488 A1 Jan. 6, 2011

(30) Foreign Application Priority Data

Mar. 13, 2008 (EP) ..... 08152708

(51) Int. Cl.

| | |
|---|---|
| ***H04R 5/02*** | (2006.01) |
| *H04S 3/00* | (2006.01) |
| *H04S 5/00* | (2006.01) |

(52) U.S. Cl.

CPC ... *H04R 5/02* (2013.01); *H04S 3/00* (2013.01); *H04R 2203/12* (2013.01); *H04R 2205/022* (2013.01); *H04S 5/005* (2013.01)

USPC ..... 381/303; 381/27; 381/307; 381/304; 381/82

(58) Field of Classification Search

CPC ..... H04R 5/02; H04R 1/22; H04R 1/225; H04R 1/227; H04R 1/24; H04R 2400/13; H04R 2499/13; H04R 2205/024; H04R 2203/12; H04R 2201/025; H04R 2201/029; H04R 29/002; H04R 29/001; H04R 3/04; H04R 1/025; H04R 1/026

USPC ..... 381/97, 98, 80, 300, 301, 302, 303, 381/304, 305, 307, 59, 87, 89, 332, 334, 381/335, 336, 103, 161, 386, 387, 389, 124, 381/82

See application file for complete search history.

(56) References Cited

U.S. PATENT DOCUMENTS

| | | | | |
|---|---|---|---|---|
| 4,112,256 | A * | 9/1978 | Carlsson | 381/332 |
| 5,227,591 | A * | 7/1993 | Tarkkonen | 181/145 |

(Continued)

FOREIGN PATENT DOCUMENTS

| | | | |
|---|---|---|---|
| WO | 9720450 | A1 | 6/1997 |
| WO | 9853641 | A1 | 11/1998 |

*Primary Examiner* — Leshui Zhang
(74) *Attorney, Agent, or Firm* — Jones Day

(57) ABSTRACT

A driver arrangement for a speaker array (201) comprises a first and second driver (301, 303) each arranged with an on-axis direction at an angle to an on-axis direction of the speaker array (201). The first driver angle exceeds 5° and the second driver angle exceeds the first angle. A front section of each driver (301, 303) comprises a front edge of a radiating element and parts of the driver in front thereof. The drivers (301, 303) are arranged at least partly inline such that a first distance from a front axis (311) perpendicular to an on-axis of the speaker array (201), and intersecting a furthest forwards part of the first driver front section, to a closest part of the second driver front section is lower than a second distance from the front axis (311) to a furthest part of the first driver front section. The combination of angled drivers and the inline arrangement provides improved performance.

13 Claims, 4 Drawing Sheets

(56) References Cited

U.S. PATENT DOCUMENTS 5,870,484 A * 2/1999 Greenberger ..... 381/300
7,231,053 B2 6/2007 Polk, Jr.
2006/0072773 A1 4/2006 Hughes, II et al.
2007/0165876 A1 * 7/2007 Meynial ..... 381/82

* cited by examiner

SPEAKER ARRAY AND DRIVER ARRANGEMENT THEREFOR

FIELD OF THE INVENTION

The invention relates to a driver arrangement for a speaker array, and in particular, but not exclusively to a speaker array suitable for generation of pseudo surround signals from a reduced number of speaker locations.

BACKGROUND OF THE INVENTION

In recent years, spatial sound provision from more than two channels has become increasingly popular such as e.g. evidenced by the wide popularity of various surround sounds systems. For example, the increased popularity of home cinema systems has resulted in a surround systems being common in many private homes. However, a problem with conventional surround systems is that they require a high number of separate speakers located at suitable positions.

For example, a conventional Dolby 5.1 surround system requires right and left rear speakers, as well front centre, right and left speakers. In addition, a low frequency subwoofer may be used.

The high number of speakers not only increases cost but also results in reduced practicality and increased inconvenience to users. Accordingly, research has been undertaken in order to generate speaker sets that are suitable for reproducing or emulating surround sound systems but using a reduced number of speaker positions. Such speaker arrays use directional sound transmissions to direct sounds in directions that will result in them reaching the user via reflections from objects in the sound environment. For example, high frequency signals (which tend to provide most of the perceptual directional cues to a listener) can be directed so that they will reach the listener via reflections off of sidewalls thereby providing an impression to the user that the sound originates from the side (or even behind) the listener.

FIG. 1 illustrates an example of a speaker array capable of providing a surround sound experience using fewer speaker boxes than in a conventional surround sound system.

In the system, the speaker array comprises symmetric left and right speaker arrangements with each speaker array comprising three driver units 101-111 each of which is enclosed in an individual cabinet section.

The surround sound system can generate a direct centre signal by providing identical in-phase signals to the left and right speaker arrangement. Furthermore, front right and left sound signals can be generated by supplying individual right and left signals to the right and left speaker arrangement respectfully. In addition, the speaker array allows directional signals to be transmitted in an outwardly sideways direction. These signals may predominantly be high frequency signals that can emulate surrounds speakers by the signals reaching the listener via reflections off of e.g. walls behind or to the side of the listener.

The direction and degree of directionality of the resulting combined signals emitted from the surround sound system as a whole can be controlled by adjusting the phase difference (or equivalently the delay) between the individual signals being provided to the individual drivers 101-111. However, such audio beamforming can be complex and suboptimal and can result in degradations. In order, to assist and reduce the required beamforming, the individual drivers 101-111 are angled in different directions.

Specifically, a speaker array such as that shown in FIG. 1 can be used to provide a directional transmission of signals such that these can be reflected off of objects to provide sideways (or rearwards) directional cues. However, in addition the speaker array is used to generate a notch which is directed towards the assumed listening position. An audio notch corresponds to an area wherein the sound signals from the different drivers are received out of phase. This results in the sound being perceived as diffuse by the listener and no specific directional cues are perceived. Thus, within the notch, a diffuse sound signal is received that the user cannot determine a specific source location for. Such a diffuse signal can provide an improved sound experience and especially can allow a single centrally placed speaker box to provide sound corresponding to side or rear channels of a surround sound signal without these appearing to originate directly from the speaker box. For example, the notch can allow the user to perceive a sound signal even if the audio environment is such that reflected surround sound signals do not reach the listener. Thus, even if the reflected surround sound signals do not reach the listener, the notch can provide the listener with a diffuse non-directional sound signal carrying the corresponding audio. Thus, the provision of the notch in the direction of the listener provides an improved sound perception from a single speaker box and may enhance robustness of the system to variations in the environment in which it is used.

In order to achieve the best compromise between reflected and direct sound, it is advantageous that the outer drivers 101, 103, 107, 109 are angled outwards. However, in order to optimize performance of the notch (and specifically in order to direct the notch inwards towards the assumed listening position), the outer drivers 101, 103, 107, 109 should by preference be angled inwards.

In the system, the two outer speakers 101, 103, 107, 109 of each speaker arrangement are used to generate the reflected signals and the notch, and in order to provide an acceptable trade off between the conflicting requirements, the middle drivers 103, 109 are angled at a first angle relative to the front of the speaker array and the outer drivers 101, 107 are angled outwards relative to the middle drivers 103, 109. Furthermore, a delay is introduced between the drivers to angle the notch further inwards.

Thus, in the speaker array of FIG. 1, one driver 105, 111 (of each arrangement) is angled directly towards the front, a second middle driver 103, 109 is angled outwards at a first angle and a third outer driver 101, 107 is angled further outwards.

However, although this arrangement provides a suitable arrangement for generating directional signals for reflections, audio beamforming processing is still required in order to direct the resulting notches inwards. Thus, if no delay is introduced between the signals to the outer drivers 101, 103, 107, 109, the resulting notch is still angled outwards and a delay of the signal to the middle driver 103, 109 is required in order to angle the notch inwards towards the assumed listening position.

However, a problem in introducing such a delay is that it tends to introduce audible artifacts that reduce the perceived audio quality. Specifically, sidelobes are generated for higher frequencies resulting in sound components being radiated in undesired directions. This tends to diminish the surround sound effect and to introduce some coloration due to comb filtering.

Also, the speaker array arrangements of FIG. 1 impose a strong limitation on the minimum depth of the system. For example, a system using 65 mm drivers easily results in a minimum depth (Y) of the speaker array of ca. 110 mm. This is highly undesirable in many situations. In particular, as speaker arrays such as that of FIG. 1 are often used with flat screen televisions, the increased depth of the speaker array tends to be perceived as highly undesirable by most consumers.

Hence, an improved speaker array arrangement would be advantageous and in particular an arrangement allowing increased flexibility, facilitated implementation, facilitated manufacturing, a reduced physical size, improved notch generation, improved audio quality and/or improved performance would be advantageous.

SUMMARY OF THE INVENTION

Accordingly, the Invention seeks to preferably mitigate, alleviate or eliminate one or more of the above mentioned disadvantages singly or in any combination.

According to an aspect of the invention there is provided an apparatus in accordance with driver arrangement for a speaker array, the driver arrangement comprising: a first driver arranged with an on-axis direction at a first angle to an on-axis direction of the speaker array, the first angle exceeding 5° and the first driver having a first driver front section comprising a front edge of a radiating element of the first driver and parts of the first driver in front of the front edge; a second driver arranged with an on-axis direction at a second angle to the on-axis direction of the speaker array, the second driver having a second driver front section comprising a front edge of a radiating element of the second driver and parts of the second driver in front of the front edge and the second angle being larger than the first angle; wherein a first distance from a front axis perpendicular to the on-axis of the speaker array, and intersecting a furthest forward part of the first driver front section, to a closest part of the second driver front section is lower than a second distance from the front axis to a furthest part of the first driver front section.

The invention may allow an improved performance of the speaker array and/or may allow facilitated and/or improved manufacturing and/or implementation. In particular, the invention may allow improved audio quality and may e.g. allow improved generation of notches in the audio environment. The invention may in many embodiments allow a reduced size of the speaker array. In particular, a reduced depth may be achieved. The invention may allow improved generation of audio signals suitable for providing a pseudo surround sound experience from a reduced number of speaker locations.

The invention may allow improved trade off between characteristics of a generated notch and directional signals aimed in different directions. For example, for a surround sound application, an improved trade-off between characteristics of sound signals directed sideways in order to provide a surround sound experience from reflections and a notch signal directed towards a listening position can be achieved.

The invention may in many cases reduce the requirements for audio beam processing resulting in improved audio quality. For example, a reduction of a delay between the first and second driver can often be achieved resulting in reduced audio quality degradation resulting from side lobes and/or coloration.

The driver front sections comprise a front edge of a radiating element of the second driver and parts of the first driver in front of the edge of the radiating element when considering the drivers in isolation. Thus, a driver front section is defined by the front of the driver and is independent of the speaker arrangement.

In some embodiments, the front sections may consist only in a driver front edge of the radiating element.

The on-axis direction of a driver may specifically be a symmetric radiation axis. For example, a driver may be rotationally invariant or symmetric around the on-axis direction. The on-axis direction may be the direction of highest sound output of the driver. Thus, the on-axis direction may correspond to the direction in which the maximum sound energy is radiated. The on-axis direction may specifically be defined by an axis through a center of the driver.

The drivers may specifically be identical and may e.g. be individual speakers or sound transducers.

In accordance with an optional feature of the invention, a distance from the front axis to a closest part of the front edge of the radiating element of the second driver is lower than a distance from the front axis to a furthest part of the front edge of the radiating element of the first driver.

This may provide a particularly advantageous implementation and/or performance. In particular, it may allow an improved trade-off between implementation, audio quality, surround sound experience, and/or physical dimensions.

In accordance with an optional feature of the invention, the driver arrangement comprises a first driver sub-arrangement comprising the first driver and the second driver and a second driver sub-arrangement, the second driver sub-arrangement comprising: a third driver arranged with an on-axis direction at a third angle to an on-axis direction of the speaker array, and a fourth driver arranged with an on-axis direction at a fourth angle to the on-axis direction of the speaker array.

This may provide a particularly advantageous implementation and/or performance. In particular, it may allow an improved trade-off between implementation, audio quality, surround sound experience, and/or physical dimensions.

The speaker array using two such speaker arrangements may in particular provide an effective and high quality pseudo surround sound experience. The speaker array may specifically comprise symmetric first and second speaker arrangements. The first and second speaker arrangements may correspond to a left and right speaker arrangement.

In accordance with an optional feature of the invention, the on-axis direction of the speaker array corresponds to an axis of symmetry between the first driver sub-arrangement and the second driver sub-arrangement.

This may provide a particularly advantageous implementation and/or performance.

In accordance with an optional feature of the invention, the on-axis direction of the speaker array corresponds to an axis of symmetry for at least one of: the on-axis directions of the first driver and the third driver; and the on-axis directions of the second driver and the fourth driver.

This may provide a particularly advantageous implementation and/or performance.

The on-axis direction of the speaker array may specifically be defined such that the first and third angles are identical. Alternatively or additionally, the on-axis direction of the speaker array may specifically be defined such that the second and fourth angle are identical. The on-axis direction may thus correspond to the axis which halves the angle between the on-axis directions of the first and third drivers and/or the angle between the on-axis directions of the second and fourth drivers.

In accordance with an optional feature of the invention, the first distance is less than 90% of the second distance.

This may provide a particularly advantageous implementation and/or performance. In particular, it may provide a particularly advantageous trade-off between depth and audio quality and/or between properties of a generated notch and the directional signals.

In accordance with an optional feature of the invention, the first distance is between 60% and 90% of the second distance.

This may provide a particularly advantageous implementation and/or performance. In particular, it may provide a particularly advantageous trade-off between depth and audio quality and/or between properties of a generated notch and directional signals.

Particularly advantageous performance have been found for the first distance being substantially 80% of the second distance (with in particular the interval 75%-85% providing advantageous performance).

In accordance with an optional feature of the invention, the second angle is at least 5° more than the first angle.

This may provide a particularly advantageous implementation and/or performance. In particular, it may provide a particularly advantageous trade-off between reflected and direct signals for a pseudo surround sound application.

In accordance with an optional feature of the invention, the first angle is between 10° and 30° and the second angle is between 30° and 50°.

This may provide a particularly advantageous implementation and/or performance. In particular, it may provide a particularly advantageous trade-off between reflected and direct signals for a pseudo surround sound application while still allowing efficient notch areas to be generated in the audio environment.

In accordance with an optional feature of the invention, a projected distance corresponding to a distance between the furthest part of the first driver front section and the closest part of the second front sections projected onto the front axis is between 25% and 75% of a difference between the first distance and the second distance.

This may provide a particularly advantageous implementation and/or performance. In particular, it may provide a particularly advantageous trade-off between depth and audio quality and/or between properties of a generated notch and directional signals. In particular, it may in many embodiments provide a reduced coloration and comb filtering of the generated audio signal while still allowing an efficient notch to be generated.

In accordance with an optional feature of the invention, an angle given as the arcsine of a projected distance corresponding to a distance between the furthest part of the first driver front section and the closest part of the second driver front section projected onto the front axis divided by a difference between the first distance and the second distance is higher than the first angle and lower than the second angle.

This may provide a particularly advantageous implementation and/or performance. In particular, it may provide a particularly advantageous trade-off between depth and audio quality and/or between properties of a generated notch and directional signals. In particular, it may in many embodiments provide a reduced coloration and comb filtering of the generated audio signal while still allowing an efficient notch to be generated.

In accordance with an optional feature of the invention, the angle is substantially an average of the first angle and the second angle.

This may provide a particularly advantageous implementation and/or performance. In particular, it may provide a particularly advantageous trade-off between depth and audio quality and/or between properties of a generated notch and directional signals. In particular, it may in many embodiments provide a reduced coloration and comb filtering of the generated audio signal while still allowing an efficient notch to be generated.

Typically, the particularly advantageous performance can be maintained within an interval of ±5° of the average angle. The average angle may be determined as half the sum of the first and second angle.

According to another aspect of the invention there is provided a speaker array comprising at least one driver arrangement, the at least one driver arrangement comprising: a first driver arranged with an on-axis direction at a first angle to an on-axis direction of the speaker array, the first angle exceeding 5° and the first driver having a first driver front section comprising a front edge of a radiating element of the first driver and parts of the first driver in front of the front edge; a second driver arranged with an on-axis direction at a second angle to the on-axis direction of the speaker array, the second driver having a second driver front section comprising a front edge of a radiating element of the second driver and parts of the second driver in front of the front edge and the second angle being larger than the first angle; wherein a first distance from a front axis perpendicular to the on-axis of the speaker array, and intersecting a furthest forward part of the first driver front section, to a closest part of the second driver front section is lower than a second distance from the front axis to a furthest part of the first driver front section.

According to an aspect of the invention there is provided a surround sound system for generating a surround sound experience from a single speaker array comprising at least one driver arrangement, the at least one driver arrangement comprising: a first driver arranged with an on-axis direction at a first angle to an on-axis direction of the speaker array, the first angle exceeding 5° and the first driver having a first driver front section comprising a front edge of a radiating element of the first driver and parts of the first driver in front of the front edge; a second driver arranged with an on-axis direction at a second angle to the on-axis direction of the speaker array, the second driver having a second driver front section comprising a front edge of a radiating element of the second driver and parts of the second driver in front of the front edge and the second angle being larger than the first angle; wherein a first distance from a front axis perpendicular to the on-axis of the speaker array, and intersecting a furthest forward part of the first driver front section, to a closest part of the second driver front section is lower than a second distance from the front axis to a furthest part of the first driver front section.

According to an aspect of the invention there is provided a method of providing a driver arrangement for a speaker array, the method comprising: providing a first driver arranged with an on-axis direction at a first angle to an on-axis direction of the speaker array, the first angle exceeding 5° and the first driver having a first driver front section comprising a front edge of a radiating element of the first driver and parts of the first driver in front of the front edge; providing a second driver arranged with an on-axis direction at a second angle to the on-axis direction of the speaker array, the second driver having a second driver front section comprising a front edge of a radiating element of the second driver and parts of the second driver in front of the front edge and the second angle being larger than the first angle; wherein a first distance from a front axis perpendicular to the on-axis of the speaker array, and intersecting a furthest forward part of the first driver front section, to a closest part of the second driver front section is lower than a second distance from the front axis to a furthest part of the first driver front section.

These and other aspects, features and advantages of the invention will be apparent from and elucidated with reference to the embodiment(s) described hereinafter.

BRIEF DESCRIPTION OF THE DRAWINGS

Embodiments of the invention will be described, by way of example only, with reference to the drawings, in which.

DETAILED DESCRIPTION OF SOME EMBODIMENTS OF THE INVENTION

The following description focuses on embodiments of the invention applicable to a speaker array for generating a pseudo surround sound experience. However, it will be appreciated that the invention is not limited to this application but may be applied to many other speaker arrays.

Figure 2:
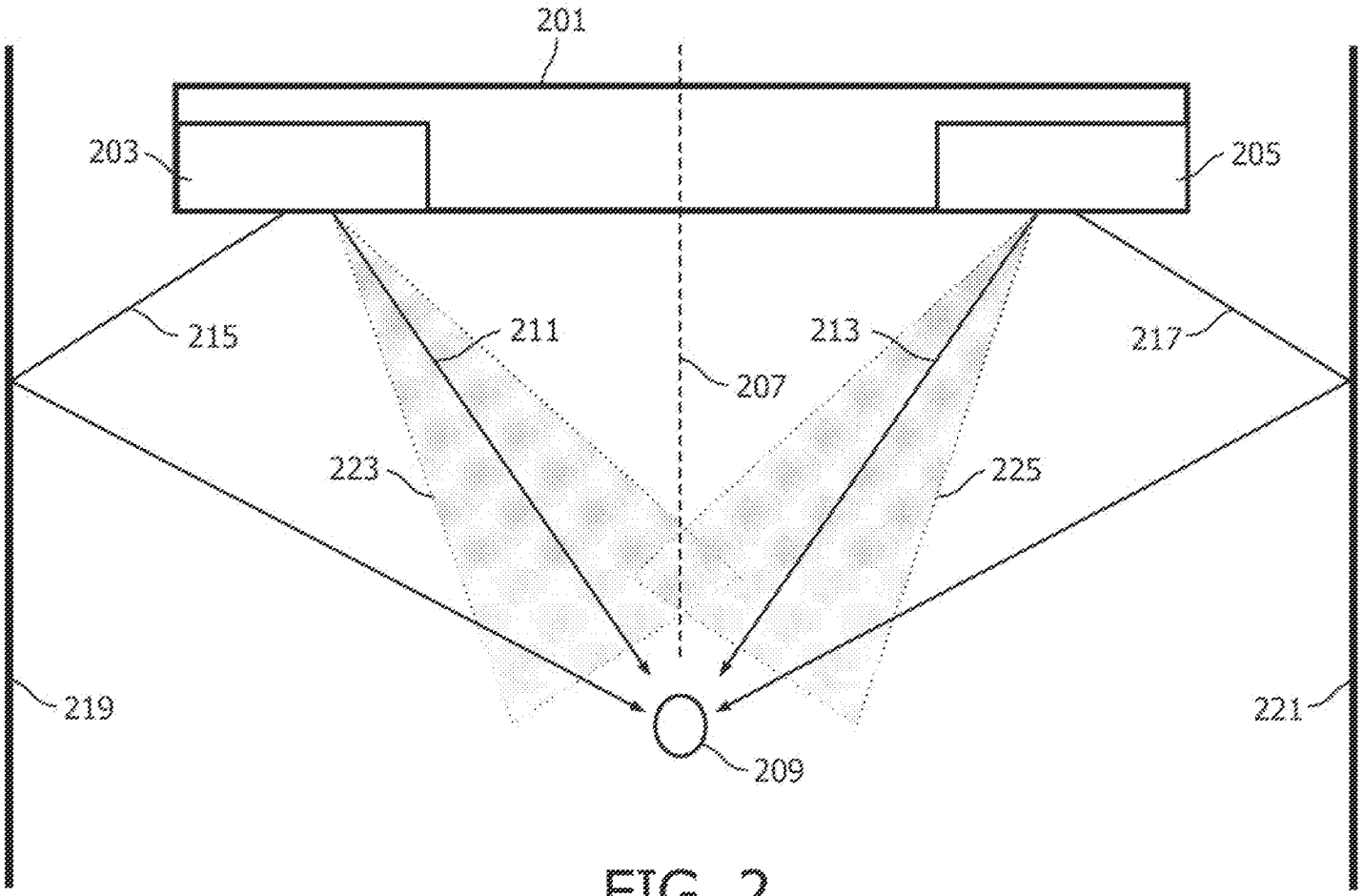
FIG. 2 illustrates an example of a speaker array in accordance with some embodiments of the invention.

FIG. 2 illustrates an example of a speaker array 201 in accordance with some embodiments of the invention. In the example, the speaker array 201 is used for generating a pseudo surround signal using only the speaker array 201. The speaker array 201 comprises two driver arrangements 203, 205 which in the specific example are symmetric around a central axis of symmetry 207 of the speaker array 201. In the example, the central axis of symmetry 207 corresponds to the on-axis direction of the speaker array 201. In the example, the on-axis direction is substantially perpendicular to the front of the speaker array 201.

The speaker array 201 is used to provide a pseudo surround source experience at a listening position 209. The speaker array 201 is designed to direct sound signals 211, 213 directly from the speaker arrangements to the listening position 209. These signals can create spatial impression along the direction of the speaker array 201. Specifically, a left or right sound source position can be provided by transmitting corresponding left and right signals from only the left or right speaker arrangement 203, 205 respectively. A central sound source position can be achieved by transmitting a corresponding central signal from both the left or right speaker arrangement 203, 205 with the amplitude and phase of the signals fed to the individual speaker arrangements 203, 205 being identical.

In addition, the speaker array 201 is arranged to allow directional signals 215, 217 to be transmitted outwardly. These signals 215, 217 reach the listening position via reflections that in the present case are reflections of side walls 219, 221. Thus, the sideways projected signals are perceived as sound source positions to the side of the listening position and accordingly can provide a pseudo surround sound experience to a listener at the listening position 209 (or relatively close thereto). It will be appreciated that in some embodiments reflections of e.g. a rear wall may be used to provide the impression of a sound source behind the listening position.

However, the quality and direction of the reflected sound signals reaching the listening position will depend on the specific audio environment in which the speaker array 201 is used and will specifically depend on the presence and characteristics of objects that can provide the required reflections. For example, in some environments it is not possible to obtain reflections that are fully able to provide a complete surround sound experience based only on reflected signals. For example, in extreme cases there may be no reflections reaching the listener and accordingly the listener may not perceive any spatial surround sounds as the reflected surround signals disappear from the sound image perceived by the user.

Accordingly, the speaker array 201 is further arranged to generate notch areas 223, 225 for the surround signals. In the notch areas 223, 225 the surround sound received from the two speaker arrangements 203, 205 are received out of phase resulting in a diffuse sound experience by the listener. The diffuse sound may provide the user with the sound of the side or surround channels without introducing any directional cues for these signals. In particular, the diffuse sound of the notch can provide the user with the sound of the surround channels without these being perceived to originate from the speaker array 201. Indeed, any directional cues for such signals will be picked up from the reflected signals.

Thus, the surround sound signals are projected both directionally towards side objects for reflections and as a diffuse signal towards the listener. The approach assures that if suitable reflections can be exploited, a strong surround sound experience can be achieved while at the same time ensuring that the perception of surround sounds is not limited to scenarios where strong reflections are present. Indeed even in the absence of reflections the surround sound is still perceived (albeit) non-directionally by the listener. Indeed in typical scenarios the perceived surround sound experience is more dominated by the diffuse sound signal of the notch than by the reflected sound signals.

A problem with the desired approach is that the requirements for the driver arrangements in order to achieve a high separation between direct and reflected signals tends to be in conflict with the requirements in order to achieve inwardly directed notch areas 223, 225.

Figure 1:
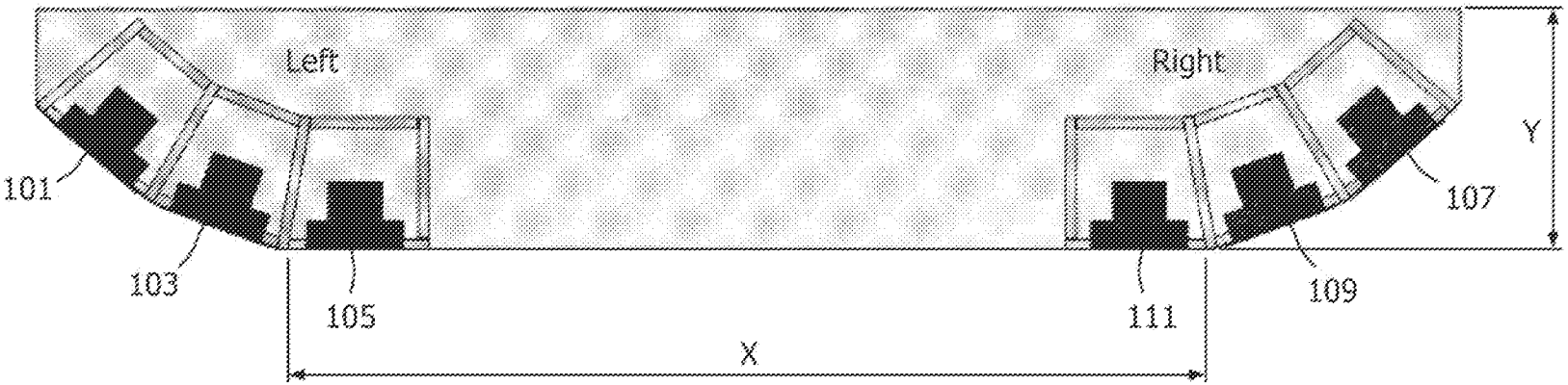
FIG. 1 PRIOR ART
FIG. 1 illustrates an example of a speaker array in accordance with prior art.

In the prior art system of FIG. 1, the outer drivers 101, 103, 107, 109 are angled outwardly in order to provide good separation between directed and reflected signals. However, as a consequence the notch areas will tend to also be directed outwardly. In order to angle the notch areas further inwardly a delay may be introduced to the middle driver 103, 109. However, such processing tends to not only change the direction but also the shape of the generated audio beam. Specifically, it tends to introduce sidelobes which may degrade the experience and may also lead to coloration.

In the speaker array 201 of FIG. 2, the individual driver arrangements 203, 205 of the speaker array 201 are such that an improved performance can be achieved. In particular, a reduced depth of the speaker array 201 can be achieved. Furthermore, improved notches can be generated and especially the drivers are arranged such that the notch areas 223, 225 are angled further inwards thereby necessitating less beamforming (e.g. less inter-driver delay) resulting in improved sound quality. It will be appreciated that in some embodiments a delay may be introduced between the drivers to angle the notch further outwards.

Figure 3:
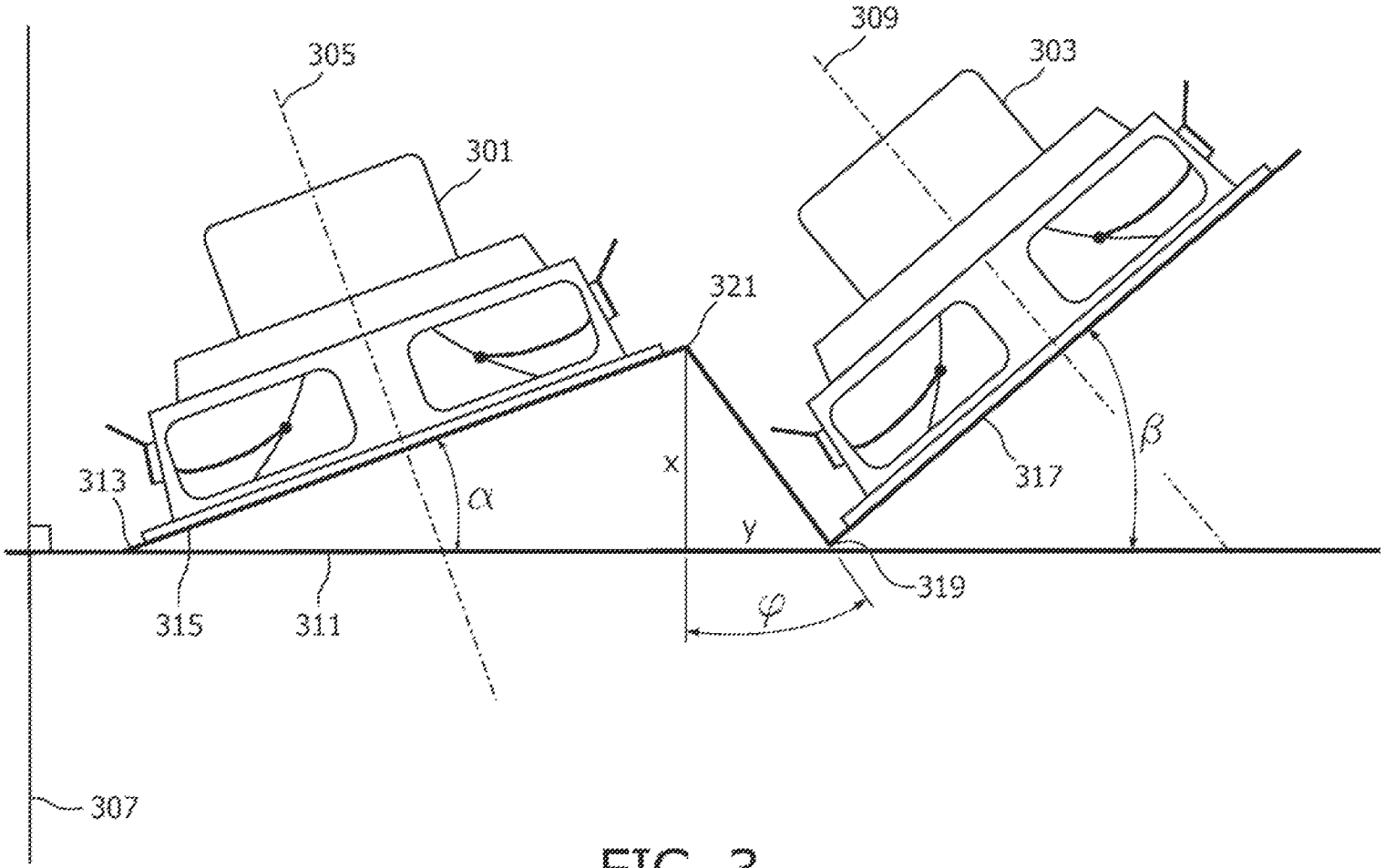
FIG. 3 illustrates an example of a driver arrangement in accordance with some embodiments of the invention.

FIG. 3 illustrates an example of a driver arrangement in accordance with some embodiments of the invention. FIG. 3 can specifically reflect the right driver arrangement 205 of the speaker array 201 of FIG. 2. In the specific example, the left driver arrangement 203 is symmetrically identical to the right driver arrangement 205 (around the central axis 207). Thus, the arrangement of FIG. 3 can also be considered a mirrored representation of the left driver arrangement 203. FIG. 3 illustrates two drivers 301, 303 but it will be appreciated that the driver arrangements 203, 205 may comprise more drivers and especially that an additional in-line speaker can be included (e.g. an in-line speaker which is angled with an on-axis direction parallel to the on-axis direction 207 of the speaker array 201).

Similarly to the prior art system of FIG. 1, the driver arrangement 205 comprises a first driver 301 and a second driver 303 which are angled outwardly in order to improve the characteristics of the directional signals being reflected to generate the surround signals. However, in contrast to the prior art system of FIG. 1, the drivers 301, 303 are at least partly arranged in an inline configuration. Indeed, the inventors have realized that rather than degrading the performance due to the drivers increasingly interfering with each other (specifically by the second driver 303 blocking the sound signal radiated by the first driver 301), the (partial) inline arrangement actually improves performance and allows improved directional signals and/or notch areas to be generated.

In the driver arrangement of FIG. 3, the first driver 301 is arranged with an on-axis direction 305 at a first angle α to an on-axis direction 307 of the speaker array 201.

The on-axis direction for a driver may be the direction of the main beam of the driver. In many cases, the on-axis direction may be the direction in which the radiated sound pressure is maximum. Typically, the on-axis direction corresponds to an axis of symmetry for the driver and/or a radiating element of the driver. For example, radiating elements of many drivers are rotationally invariant for rotations around a line through the center of the radiating element and this line is typically the on-axis direction.

The on-axis direction of a speaker array is typically substantially perpendicular to the front of the speaker array. In particular, the on-axis direction for a speaker array is typically the direction from an ideal assumed listening location to a central point of symmetry for the speaker array. The ideal assumed listening position is typically a central position with identical distance to corresponding points of the two difference speaker areas.

The angle between the driver on-axis direction 305 and the speaker array 201 on axis direction 307 is at least 5° in order to provide an efficient outwardly directed signal for reflections.

In the driver arrangement 205, the second driver 303 is arranged with an on-axis direction 309 at a second angle β to the on-axis direction 307 of the speaker array 201. Furthermore, the second angle 13 is larger than the first angle α in order to provide an improved separation between reflected and direct signals.

In the arrangement 205, the drivers 301, 303 are furthermore arranged in a (partly) inline arrangement. Specifically, a front axis 311 of the speaker array 201 (or the individual arrangement) is defined by being perpendicular to the speaker array 201 on-axis direction 307 and by intersecting a point 313 which is the most forward point of the first driver 301. Specifically, the front axis 311 is the first contact point of a forward section of the first driver 301 which is reached by moving perpendicular plane to the speaker array on-axis direction 307 towards the speaker array 201.

It will be appreciated that in many embodiments, the front axis 311 may correspond to or be parallel to a front of the speaker array 201.

In the example, a front section of a driver is defined as the front edge of a radiating element and any part of the driver which is in front thereof. The front section of a driver is defined independently of the speaker arrangement and the driver front section is defined exclusively by reference to the front of the driver, i.e. the elements of the driver which is towards the main sound radiating direction. Specifically, the front section of a driver may be the parts of the driver which are located at the main sound radiating side of a plane perpendicular to the driver on-axis direction and intersecting a front edge of the radiating element (i.e. the edge of the radiating element which is first encountered when moving the plane towards the driver along the on-axis direction and from the direction in which the main sound signal is radiated).

In the example, a front section of a driver may thus include e.g. a surrounding metal frame used to affix the driver etc. However, it will be appreciated that in other embodiments, the front section may be defined to include parts of only the radiating element. Specifically, the front section of a driver may be defined as the driver front radiating element edge.

In the speaker arrangement of FIG. 3, the first and second drivers 301, 303 each have a front section 315, 317 which is perpendicular to the driver on-axis direction 305, 309. Accordingly, the angle α between the driver on axis direction 305 for the first driver 301 and the speaker array on axis direction 307 is identical to the angle between the front axis 311 and the front section 315 of the first driver 301. Similarly, the angle 13 between the driver on axis direction 309 for the second driver 303 and the speaker array on axis direction 307 is identical to the angle between the front axis 311 and the front section 317 of the second driver 303.

In the arrangement, a first distance from the front axis 311 to a closest part 319 of the second driver front section 317 is lower than a second distance x from the front axis 311 to a furthest (most distant) part of the first driver front section 315. Thus, the minimum distance between the front axis 311 and the second driver front section 317 is lower than the maximum distance between the front axis 311 and the first driver front section 315.

Thus, in an embodiment wherein the driver front sections are defined to include only parts of the radiating elements, the distance from the front axis 311 to a closest part of the front edge of the radiating element of the second driver 303 is lower than a distance from the front axis 311 to a furthest part of the front edge of the radiating element of the first driver 301.

The arrangement of the drivers in the speaker arrangement of FIG. 3 is thus at least partially an inline arrangement. In the specific example, a full inline arrangement is used wherein the forward part of both drivers intersect the front axis.

In contrast to the conventional assumption that drivers of a speaker array 201 should be located outside the audio beam of other drivers in order to prevent interference and distortions (e.g. undesired blocking, diffraction and reflections), the use of a partial inline arrangement of angled drivers in the example of FIG. 3 provides a number of advantages.

Firstly, it allows a reduced depth of the speaker array 201 which may be particularly important for pseudo surround sound applications that are often used with flat screen televisions. Secondly, the arrangement provides improved performance and specifically the (partial) inline arrangement allows the naturally generated notch areas to be further angled inwards. Accordingly, a reduced beamforming/delay is needed thereby reducing the distortions and degradations typically associated therewith.

Specifically, for a completely inline arrangement as illustrated in the example of FIG. 3, substantial inwards angling of the notch area is achieved and in general the notch is angled more and more inwards for an increasing inline arrangement. This is similar to adding delay to the inner speaker and accordingly the inline placement allows this delay to be reduced thereby reducing the creation of side lobes that are inherent to the delay approach.

In the specific example, the speaker array 201 comprises symmetric driver arrangements corresponding to that of FIG. 3. Thus, the first driver arrangement 203 also comprises two drivers angled outwards with angles corresponding to the angles α and β. However, relative to the on-axis direction 307 of the speaker array 201, the angles are opposite (i.e. −α and −β).

Indeed, the on-axis direction 307 is in the specific example identical to the axis of symmetry 207 and is specifically the axis of symmetry between the corresponding drivers of the two driver arrangements.

It will be appreciated that in different embodiments, the exact angling and displacement of the driver units may be used.

A large number of experiments and simulations have specifically shown that for the first distance (the minimum distance from the front axis 311 to the second driver front section 317) being less than 90% of the second distance (the maximum distance from the front axis 311 to the first driver front section 315) leads to advantageous performance in many scenarios and applications. In particular, a ratio of around 80% provides close to optimum performance in many embodiments with ratios between 60% and 90% being advantageous for most applications.

Furthermore, experiments have demonstrated that a first angle $\alpha$ between 10° and 30° and a second angle $\beta$ between 30° and 50° provide highly advantageous performance. In particular, a difference of at least 5° between the angles tends to provide improved performance.

It has been found that in many embodiments, close to optimum performance is achieved for a first angle around 20°, a second angle around 40° and a distance ratio of around 80%.

Thus, the described values have been identified as providing particularly advantageous trade-offs between the different and typically conflicting requirements of direct and reflected signal differentiating and notch area angling.

In the driver arrangement of FIG. 3, the second driver 303 is furthermore moved outwards from the first driver in a direction parallel to the front axis 311.

Thus, in the example the distance between the furthest point 321 of the first driver front section 315 and the closest point 319 of the second driver front section 317 corresponds to an inline distance x parallel to the speaker array on-axis direction 307 and a sideways distance y parallel to the front axis 311. Thus, the sideways distance y corresponds to a distance between the furthest part 321 of the first driver front section 315 and the closest part of the second driver front section 317 projected onto the front axis 311.

It will be appreciated that the performance of the speaker array 201 may further depend on the sideways distance and experiments and simulations have demonstrated that particularly advantageous performance can be achieved if the sideways distance y is between 25% and 75% of the inline distance x.

Figure 4:
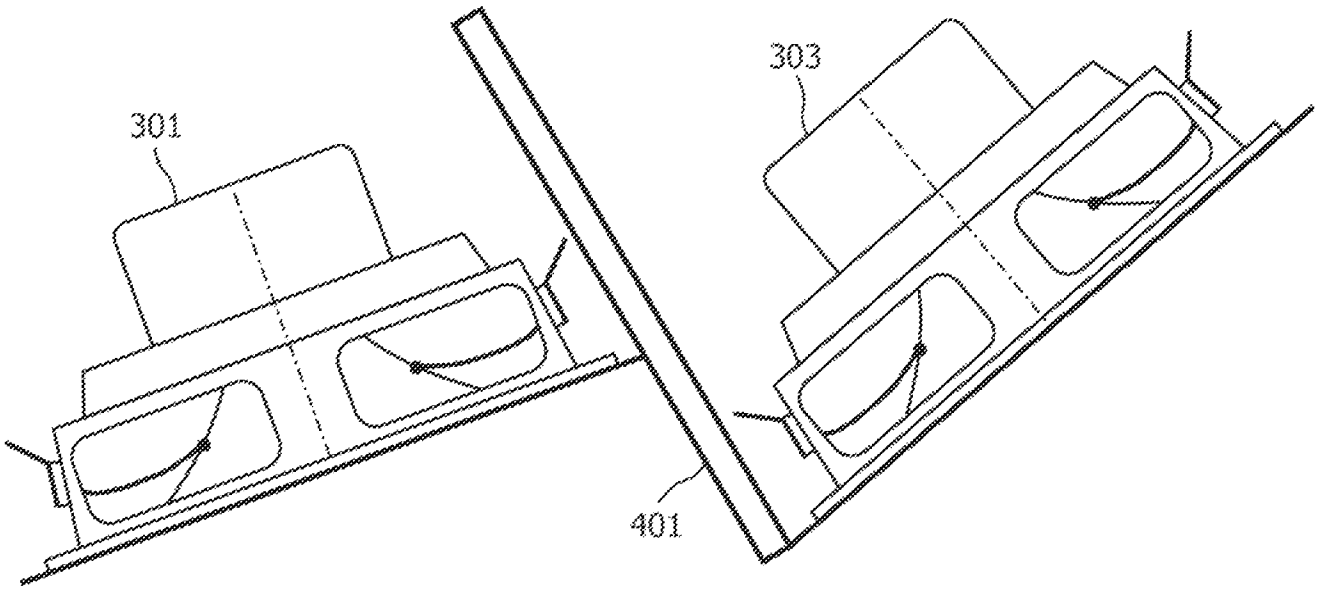
FIG. 4 illustrates an example of a driver arrangement in accordance with some embodiments of the invention

In more detail, a consequence of the at least partial inline arrangement, the second driver 303 provides an obstruction to the sound radiated from the first driver 301. As illustrated in FIG. 4, this may be considered to correspond to a blocking 'wall' 401 being created between the two drivers 301, 303. This will tend to lead to diffraction and comb filtering, which can be heard as coloration. Thus, some degradation may occur. The degradation can often be compensated by equalizing the signals provided to the speaker array 201.

However, it is desirable to reduce the effect of this blocking and this may be achieved by decreasing the inline distance x and/or increasing the sideways distance y. However, this will also result in an increase of the physical dimensions of the speaker array 201. Furthermore, increasing the sideways distance will result in an increased de-correlation between the drivers thereby resulting in a reduced notch effect.

Thus, it is important to optimize the distances to find a suitable trade-off between these ratios.

From many experiments and simulations, it has been determined that if the inline angle $\phi$ of FIG. 3 is selected to be between the first angle $\alpha$ and the second angle $\beta$ particularly advantageous operation can be achieved. Specifically, the inline angle $\phi$ can be defined as the arctangent ($\tan^{-1}$) of the sideways distance divided by the inline distance:

$$\phi = \mathrm{Arctan}(y/x)$$

The distances may then be designed to meet the requirement $\alpha < \phi < \beta$.

Thus, this selection may in many embodiments ensure that the introduced blocking does not result in unacceptable audio quality degradation, that an acceptable notch effect is achieved, that a suitable separation between direct and reflected signals is achieved and that the dimensions (in particular the depth) of the speaker array is reduced.

Experiments have demonstrated that particularly advantageous performance can be achieved by setting the angle $\phi$ substantially equal to an average of the first angle and the second angle, i.e.

$$\varphi \cong \frac{\alpha + \beta}{2}$$

It will be appreciated that the above description for clarity has described embodiments of the invention with reference to different functional units and processors. However, it will be apparent that any suitable distribution of functionality between different functional units or processors may be used without detracting from the invention. For example, functionality illustrated to be performed by separate processors or controllers may be performed by the same processor or controllers. Hence, references to specific functional units are only to be seen as references to suitable means for providing the described functionality rather than indicative of a strict logical or physical structure or organization.

The invention can be implemented in any suitable form including hardware, software, firmware or any combination of these. The invention may optionally be implemented at least partly as computer software running on one or more data processors and/or digital signal processors. The elements and components of an embodiment of the invention may be physically, functionally and logically implemented in any suitable way. Indeed the functionality may be implemented in a single unit, in a plurality of units or as part of other functional units. As such, the invention may be implemented in a single unit or may be physically and functionally distributed between different units and processors.

Although the present invention has been described in connection with some embodiments, it is not intended to be limited to the specific form set forth herein. Rather, the scope of the present invention is limited only by the accompanying claims. Additionally, although a feature may appear to be described in connection with particular embodiments, one skilled in the art would recognize that various features of the described embodiments may be combined in accordance with the invention. In the claims, the term comprising does not exclude the presence of other elements or steps.

Furthermore, although individually listed, a plurality of means, elements or method steps may be implemented by e.g. a single unit or processor. Additionally, although individual features may be included in different claims, these may possibly be advantageously combined, and the inclusion in different claims does not imply that a combination of features is not feasible and/or advantageous. Also the inclusion of a feature in one category of claims does not imply a limitation to this category but rather indicates that the feature is equally applicable to other claim categories as appropriate. Furthermore, the order of features in the claims do not imply any specific order in which the features must be worked and in particular the order of individual steps in a method claim does not imply that the steps must be performed in this order. Rather, the steps may be performed in any suitable order. In addition, singular references do not exclude a plurality. Thus references to "a", "an", "first", "second" etc do not preclude a plurality. Reference signs in the claims are provided merely as a clarifying example shall not be construed as limiting the scope of the claims in any way.

The invention claimed is:

1. A driver arrangement for operation as one of a left and right sound source in a speaker array that defines a central forward on-axis and a front axis perpendicular to the central forward on-axis at a front portion thereof, the driver arrangement comprising:

a first driver sub-arrangement disposed on one side of the central forward on-axis of the speaker array, the first driver sub-arrangement comprising:

a first driver arranged with an first on-axis at a first angle outward from the central forward on-axis of the speaker array, wherein the first angle exceeds 5°, and wherein the first driver (301) has a first driver front section comprising a first front edge, the first front edge has an inner forward part intersecting the front axis; and a second driver arranged with an second on-axis at a second angle outward from the central forward on-axis of the speaker array, wherein the second driver has a second driver front section comprising a second front edge, wherein the second angle is larger than the first angle;

wherein the first and the second drivers output audio signals in a substantially same frequency range;

wherein a first distance defined as a closest distance from the front axis to the second front edge of the second driver is smaller than a second distance defined as a furthest distance from the front axis to the first front edge of the first driver;

wherein a projected sideways distance defined as a distance along the front axis between an orthogonal projection from a first point corresponding to the furthest part of the front section of the first driver onto said front axis and an orthogonal projection from a second point corresponding to the closest part of the front section of the second driver onto said front axis, is between 25% and 75% of a difference between the second distance and the first distance.

2. The driver arrangement of claim 1, further comprising:

a second driver sub-arrangement disposed on the other side of the central forward on-axis of the speaker array, the second driver arrangement comprising:

a third driver arranged with a third on-axis at a third angle outward from the central forward on-axis of the speaker array; and a fourth driver arranged with a fourth on-axis at a fourth angle outward from the central forward on-axis of the speaker array.

3. The speaker array of claim 2, wherein the central forward on-axis of the speaker array corresponds to an axis of symmetry between the first driver sub-arrangement and the second driver sub-arrangement.

4. The speaker array of claim 2, wherein the central forward on-axis of said speaker array corresponds to an axis of symmetry for at least one of:

the first on-axis of the first driver and the third on-axis of the third driver, and the second on-axis of the second driver and the fourth on-axis of the fourth driver.

5. The driver arrangement of claim 1, wherein the first distance is less than 90% of the second distance.

6. The driver arrangement of claim 1, wherein the first distance is between 60% and 90% of the second distance.

7. The driver arrangement of claim 1, wherein the second angle is at least 5° more than the first angle.

8. The driver arrangement of claim 1, wherein the first angle is between 10° and 30° and the second angle is between 30° and 50°.

9. The driver arrangement of claim 1, wherein an in-line angle ($\phi$) given as an arctangent of the projected sideways distance divided by a distance defined as the difference of the first distance and the second distance is higher than the first angle and lower than the second angle.

10. The driver arrangement of claim 9, where the in-line angle is substantially an average of the first angle and the second angle.

11. A speaker array defining a central forward on-axis and a front axis perpendicular to the central forward on-axis at a front portion thereof and comprising at least one driver arrangement, the at least one driver arrangement comprising:

a first driver arranged with an first on-axis at a first angle outward from the central forward on-axis of the speaker array, wherein the first angle exceeds 5°, and wherein the first driver has a first driver front section comprising a first front edge, the first front edge has an inner forward part intersecting the front axis; and a second driver arranged with an second on-axis at a second angle outward from the central forward on-axis of the speaker array, wherein the second driver has a second driver front section comprising a second front edge, wherein the second angle is larger than the first angle;

wherein the first and the second drivers output audio signals in a substantially same frequency range;

wherein a first distance defined as a closest distance from the front axis to the second front edge of the second driver is smaller than a second distance defined as a furthest distance from the front axis to the first front edge of the first driver;

wherein a projected sideways distance defined as a distance along the front axis between an orthogonal projection from a first point corresponding to the furthest part of the front section of the first driver onto said front axis and an orthogonal projection from a second point corresponding to the closest part of the front section of the second driver onto said front axis, is between 25% and 75% of a difference between the second distance and the first distance.

12. The speaker array of claim 11, wherein said speaker array produces surround sound.

13. A method of providing a driver arrangement for a speaker array that defines a central forward on-axis and a front axis perpendicular to the central forward on-axis at a front portion thereof, the method comprising acts of:

providing a first driver arranged with an first on-axis at a first angle outward from the central forward on-axis of the speaker array, wherein the first angle exceeds 5°, and wherein the first driver has a first driver front section comprising a first front edge, the first front edge has an inner forward part intersecting the front axis; and providing a second driver arranged with an second on-axis at a second angle outward from the central forward on-axis of the speaker array, wherein the second driver has a second driver front section comprising a second front edge, wherein the second angle is larger than the first angle;

wherein the first and the second drivers output audio signals in a substantially same frequency range;

wherein a first distance defined as a closest distance from the front axis to the second front edge of the second driver is smaller than a second distance defined as a furthest distance from the front axis to the first front edge of the first driver;

wherein a projected sideways distance defined as a distance along the front axis between an orthogonal projection from a first point corresponding to the furthest part of the front section of the first driver onto said front axis and an orthogonal projection from a second point corresponding to the closest part of the front section of the second driver onto said front axis, is between 25% and 75% of a difference between the second distance and the first distance.

* * * * *